US007820899B2

(12) United States Patent
Liao

(10) Patent No.: US 7,820,899 B2
(45) Date of Patent: Oct. 26, 2010

(54) CYMBAL ADJUSTMENT STRUCTURE

(76) Inventor: Tsun-Chi Liao, 1F, No. 7, Lane 545, Sec. 2, Jyungong Rd., Beitun Dist., Taichung City (TW)

( * ) Notice: Subject to any disclaimer, the term of this patent is extended or adjusted under 35 U.S.C. 154(b) by 23 days.

(21) Appl. No.: 12/350,970

(22) Filed: Jan. 9, 2009

(65) Prior Publication Data

US 2010/0175536 A1 Jul. 15, 2010

(51) Int. Cl.
*G10D 13/02* (2006.01)

(52) U.S. Cl. ..... 84/422.3

(58) Field of Classification Search ..... 84/422.3, 84/422.1, 422.2, 421
See application file for complete search history.

(56) References Cited

U.S. PATENT DOCUMENTS 7,297,853 B2 * 11/2007 Liao ..... 84/422.3

FOREIGN PATENT DOCUMENTS

TW 145792 11/1990
TW M252112 12/2004

* cited by examiner

*Primary Examiner*—Jianchun Qin
(74) *Attorney, Agent, or Firm*—Ching-Ling Huang

(57) ABSTRACT

A cymbal adjustment structure includes an upper tray, a lower tray and a nut. The upper tray has an aperture and an upper duct and a lower duct. The lower duct has a pair of troughs and holds an elastic element and a holding member inside. The lower tray is coupled outside the lower duct and has a boss on the top thereof to run through the aperture to push a lower cymbal mounted onto the upper tray at an inclined angle. The nut is fastened to the periphery of the lower tray. The lower tray is fastened to the holding member through a fastening element running through the trough. Hence by turning the nut the lower tray can be moved and adjusted upwards and downwards to allow the boss to push the washer at the bottom of the lower cymbal.

9 Claims, 7 Drawing Sheets

CYMBAL ADJUSTMENT STRUCTURE

FIELD OF THE INVENTION

The present invention relates to a cymbal holding dock of a cymbal stand and particularly to a cymbal structure to adjust the inclined angle of a lower cymbal.

BACKGROUND OF THE INVENTION

Referring to FIGS. 1 and 2, a conventional foot-stepping cymbal stand and lower cymbal angular adjustment structure mainly includes a circular holding dock 1 which has the bottom coupling with a post 2. The holding dock 1 has a coupling duct 3 extended upwards from the center of the top thereof. The coupling duct 3 is coupled, in this order, a washer 4, a shock-absorbing pad 5 and a lower cymbal 6. The post 2 is run through by a drawing bar 7 in the center that also runs through the coupling duct 3, the washer 4, pad 5 and lower cymbal 6 and fastens to an upper cymbal 8. When the foot pedal of the cymbal stand is stepped, the drawing bar 7 is moved to drive the upper cymbal 8 downwards to strike the lower cymbal 6 to generate sound. By adjusting the inclined angle of the lower cymbal 6, the upper cymbal 8 can strike the lower cymbal 6 to generate different sound effects. To make the adjustment, a screw hole is formed at one side of the holding dock 1 to be fastened by a screw 9. The screw 9 has a distal end directing upwards to push the washer 4 to tilt an inclined angle. Hence the lower cymbal 6 also is tilted at the inclined angle, and the lower cymbal 6 can form an angle with the upper cymbal 8 or in close contact therewith. As a result, a drummer can strike the cymbals to generate different sound effects.

As the washer 4 is tilted by pushing of the top distal end of the screw 9 to form a point contact support, the lower cymbal 6 is prone to wobble left and right. Thus noise is generated when the upper cymbal 8 strikes the lower cymbal 6. Moreover, the holding dock 1 tends to shake and vibrate when the upper cymbal 8 strikes the lower cymbal 6. This could cause loosening and downward moving of the screw 9 on the holding dock 1 after a period of time. As a result, the angle of the lower cymbal 6 changes, and sound effect could lose control.

R.O.C patent application No. 145792 entitled "Elevated hat-shaped cymbal holding structure" discloses a cymbal holding portion 20 fastened to the top of a post 1 that includes a rectangular holding seat 21 and a cymbal holding board 30 located on the holding seat 21. The holding seat 21 has a pair of axles 25 jutting from one side and a lifting bolt 26 directing upwards at the other side. The lifting bolt 26 is coupled with a nut 28. The holding seat 21 has a tubular barrel 23 extended from an upper side thereof. The cymbal holding board 30 has an opening 32 in the center to couple with the tubular barrel 23 on an outer side. The cymbal holding board 30 has a pair of arms 33 at one side that have an axle hole 34 coupling with the axle 25 to allow the cymbal holding board 30 to swivel. The cymbal holding board 30 has another side with the bottom thereof pushed by the top end of the lifting bolt 26 and inclined. The cymbal holding board 30 further has an upper side bonded to a pad 50 made from a felt-like material. The pad 50 has the center coupled on the tubular barrel 23 and the top portion straddled by a lower cymbal 11a.

By adjusting the elevation of the top end of the lifting bolt 26 above the top surface of the holding seat 21, another top side of the cymbal holding board 30 can be pushed upwards and the pad 50 located thereon also is tilted, therefore the inclined angle of the lower cymbal 11*a* straddled the pad 50 also can be adjusted.

However, the top end of the lifting bolt 26 also pushes the cymbal holding board 30 at a point contact. A greater stress is formed on the contact portion between the lifting bolt 26 and the cymbal holding board 30.

R.O.C. patent application No. M252112 entitled "Cymbal adjustment structure for a cymbal stand" includes a hollow post 60 which has an upper side coupled with a holding seat 10. The holding seat 10 has a holding strut 11 on the upper side, a fastening portion 12 on the lateral side. The fastening portion 12 has a longitudinal notch 13 to hold a movable member 30. The movable member 30 has a transverse internal screw hole 31 at a lower side and a trough 34 on an inner side of the upper portion to hold an elastic element 40. An anchor member 20 is provided which has a housing chamber 22 to hold the movable member 30 and a pair of tracks 23 inside. The tracks 23 are coupled with a guiding trough 32 of the movable member 30. The anchor member 20 has an aperture 24 run through by an adjustment portion 51 on an outer side of a bolt 50. The bolt 50 has a screw bar 52 fastened to the internal screw hole 31 of the movable member 30 and a distal end pushing an inner wall of the notch 13. A washer 61, a sponge 62 and a cymbal 63 are coupled in this order on the holding strut 11. The movable member 30 has an inclined surface 33 at the top rejecting a lower side at one side of the washer 61. By turning the bolt 50, the movable member 30 can be moved along the tracks 23 of the housing chamber 22 so that the inclined surface 33 can push the washer 61 higher.

As a result, the sponge 62 also is moved upwards in an inclined manner to push the cymbal 63 in an inclined manner. However, the bolt 50 still is prone to loosen and moved due to shaking and vibration caused by striking between the upper and lower cymbals 63. Moreover, the bolt 50 usually is a small one and cannot provide secured fastening. The holding seat 10 in contact with the washer 61 has to support the downward pressure from the cymbals 63 at a small area which is easily damaged. All this shows that there are still rooms for improvement.

SUMMARY OF THE INVENTION

Therefore, the primary object of the present invention is to provide a cymbal adjustment structure to make adjustment of inclination of the lower cymbal easier, and to resolve the loosening problem of screw or bolt occurred to the conventional cymbal stands.

To achieve the foregoing object, the cymbal adjustment structure of the invention includes an upper tray, a lower tray and a nut. The upper tray is mounted on a cymbal post and has an aperture and a flange on the perimeter to hold a washer in a straddled manner.

The lower tray has an external thread on the periphery and a boss at the top. The lower tray is coupled with the upper tray with the boss running through the aperture of the upper tray. Through the boss, a force can be exerted to a lower cymbal to change an inclined angle thereof.

The nut has an internal thread to fasten to the external thread of the lower tray and anchor the lower cymbal at the inclined position. It has a bottom side wedged by heads of a pair of opposing latch elements.

Thus by turning the nut, the lower tray can be moved up and down with the boss running through the aperture of the upper tray and exerting an upward force to the lower tray to change the inclined angle of the lower cymbal to form a desired angle with the upper cymbal or in a close contact therewith. Thereby different sound effects can be generated when stricken.

The invention can provide many benefits, notably:

1. The boss pushes the lower cymbal with a flat top surface, thus has a great force receiving area compared with the conventional point contact with a screw or bolt. Hence the problem of too much stress can be overcome.

2. The nut is wedged securely by the heads of a pair of opposing latch elements, thus loosening and escaping resulting from shaking and vibration can be prevented to maintain the lower cymbal at the desired inclined angle. Loosening of the screw or lifting bolt and changing of the angle of the lower cymbal that happen to the conventional adjustments can be avoided. Sound generation effect can be better controlled. The nut of the invention is formed at a greater size, and can be grasped and handled easier by user's hand. Hence adjustment also is simpler.

3. The upper tray has the flange formed on the perimeter to provide a greater force receiving area to hold the washer to support the downward pressure and gravity of the lower cymbal, thus can provide firmer support.

The foregoing, as well as additional objects, features and advantages of the invention will be more readily apparent from the following detailed description, which proceeds with reference to the accompanying embodiment and drawings. The embodiment serves only for illustrative purpose and is not the limitation of the invention.

DETAILED DESCRIPTION OF THE PREFERRED EMBODIMENT

Figure 3:
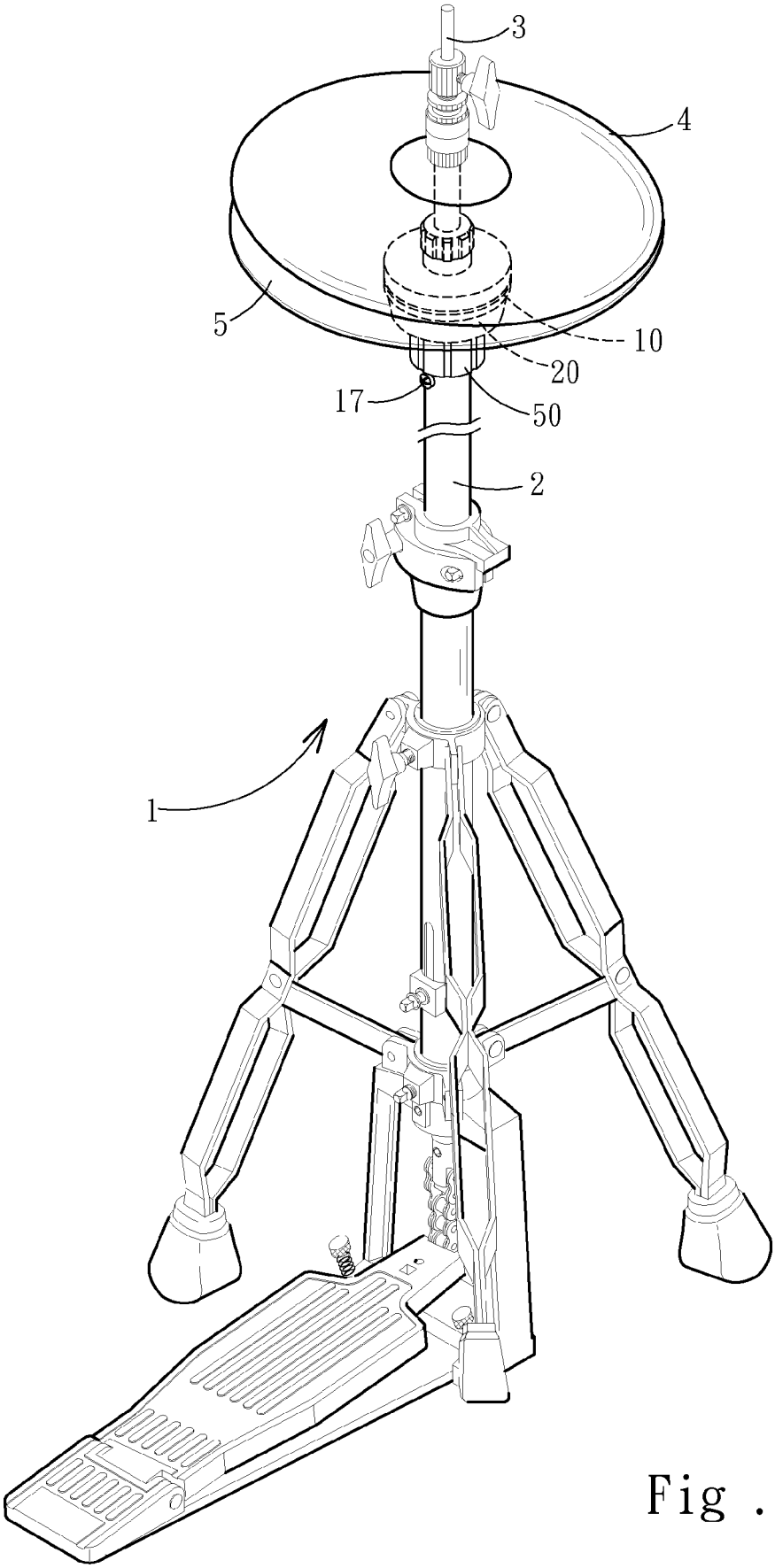
FIG. 3 is a perspective view of the cymbal stand according to the invention.
Figure 4:
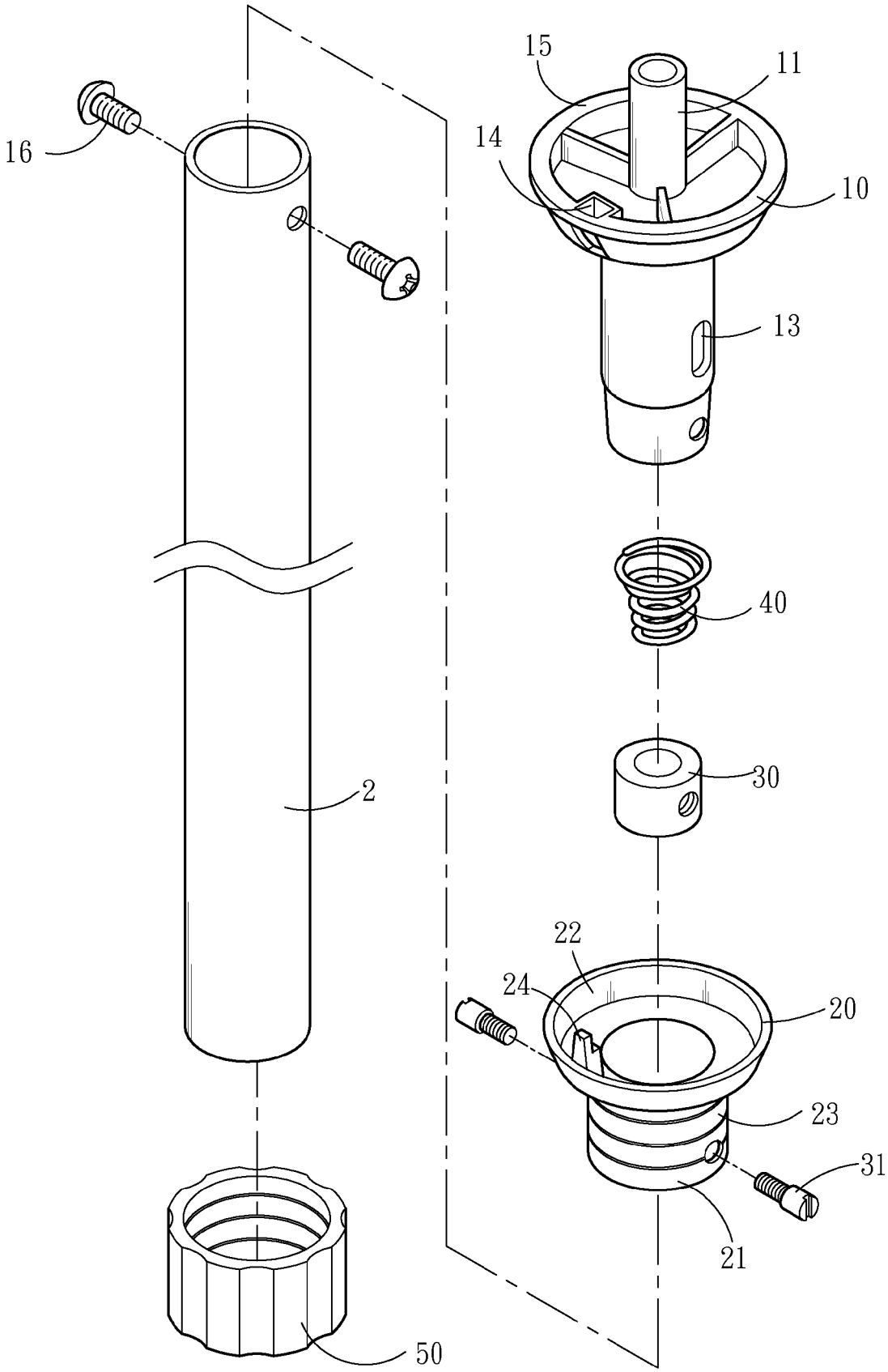
FIG. 4 is an exploded view of the invention.
Figure 5:
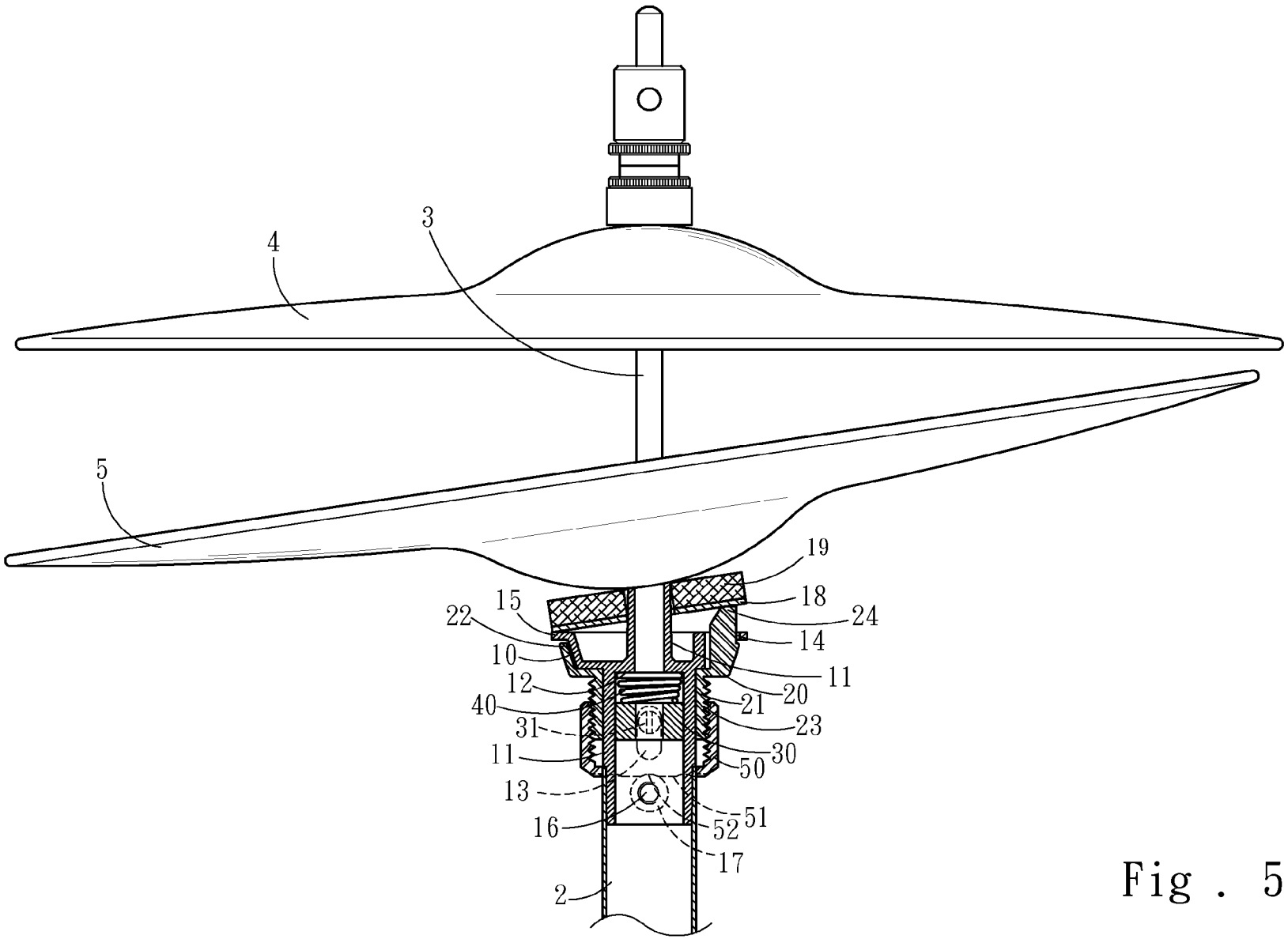
FIG. 5 is a sectional view of the invention.

Please refer to FIGS. 3, 4 and 5, the present invention provides a cymbal adjustment structure mounted on a metal post 2 of a cymbal stand 1. The post 2 holds a drawing bar 3 inside. The drawing bar 3 has an upper end fastened to an upper cymbal 4. The adjustment structure includes an upper tray 10, a lower tray 20, a holding member 30, an elastic element 40, a nut 50 and a lower cymbal 5.

The upper tray 10 is made from plastics, and has a conical bottom and a duct 11 at an upper portion and a lower portion. The duct 11 at the lower portion is coupled with the top of the post 2 to allow the drawing bar 3 to run through upwards to fasten to the upper cymbal 4. The duct 11 at the upper portion is formed at a diameter smaller than that of the lower portion to form a detent edge 12 inside. The duct 11 further 1 has a pair of troughs 13 at two sides of the tubular wall. The upper tray 10 also has an aperture 14 running through the periphery thereof up and down. The upper tray 10 further has a flange 15 extended outwards from the perimeter thereof. The post 2 has the periphery thereof fastened by at least one latch element 16 (a screw in this embodiment). The latch element 16 also fastens the duct 11 at the lower portion of the upper tray 10, and has a head 17 outside formed at a diameter greater than the latch element 16. The duct 11 at the upper portion of the upper tray 10 is coupled with a metal washer 18 and a shock-absorbing pad 19 made from fibers. The washer 18 has the bottom side straddled the top surface of the flange 15.

The lower tray 20 has a bushing 21 running through the center thereof up and down and surrounding the duct 11. The bushing 21 has a top opening 22 formed at a diameter greater than the lower side thereof to become a conical shape to hold the bottom of the upper tray 10. The lower tray 20 has an external thread 23 formed on the periphery and a boss 24 extended upwards from the top of the perimeter to run through the aperture 14 of the upper tray 10. The boss 24 has a flat top surface.

Figure 6:
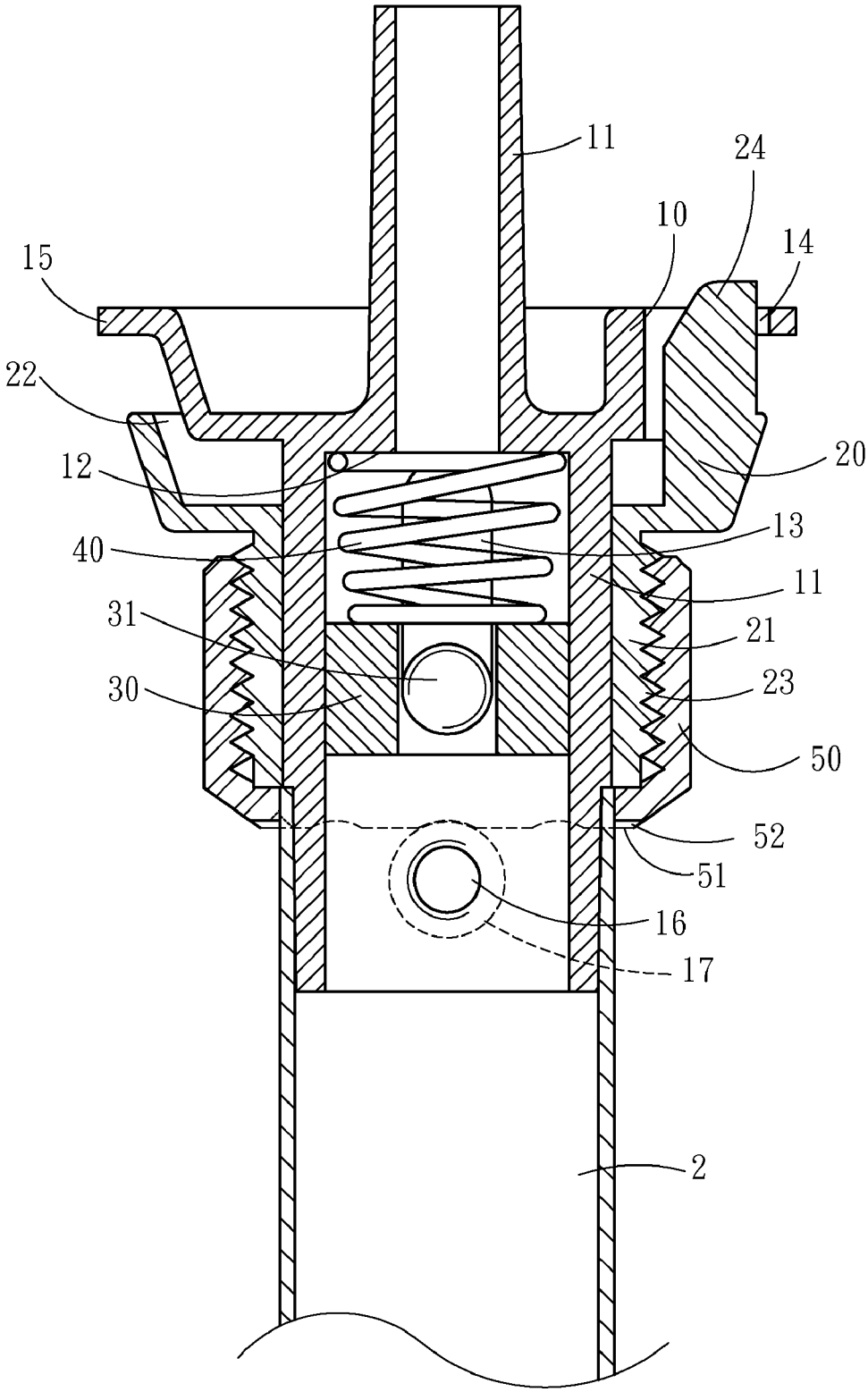
FIG. 6 is a schematic view of the invention in an operating condition.
Figure 7:
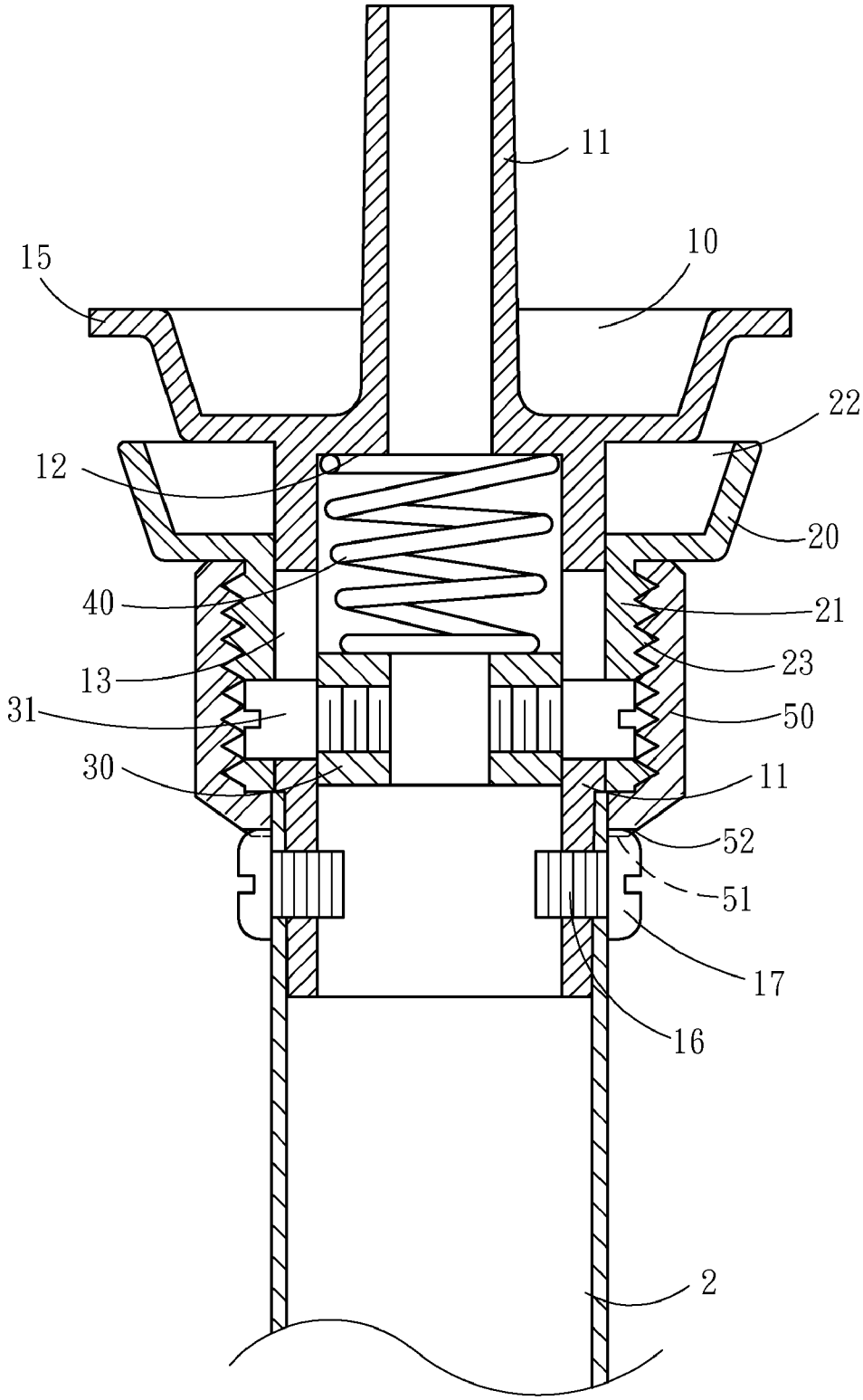
FIG. 7 is another schematic view of the invention in an operating condition.

The holding member 30 is located in the duct 11 and is fastened by at least one fastening element 31 (a pair of bolts in this embodiment) running through the troughs 13 from the outer of the bushing 21, also referring to FIGS. 6 and 7.

The elastic element 40 is a spring compressible axially and held between the holding member 30 and the detent edge 12.

The nut 50 has an internal thread to engage with the external thread 23 of the lower tray 20 and a bottom edge 51 at a lower side located on the bottom side of the bushing 21. The bottom edge 51 has a plurality of anchor grooves 52 to be latched by the head 17 of the latch element 16 for anchoring.

The lower cymbal 5 has the center coupled on the duct 11 at the upper portion of the upper tray 10. The lower tray 5 has the bottom thereof rested on the pad 19.

Referring to FIG. 6, when in use to adjust the inclined angle of the lower cymbal 5, turn the nut 50; as the nut 50 is latched by the head 17 of the latch element 16, turning of the nut 50 moves the lower tray 20 upwards and the fastening elements 31 drive the holding member 30 upwards at the same time to compress the elastic element 40 as shown in FIG. 5. The boss 24 on the outer side of the lower tray 20 is extended through the aperture 14 of the upper tray 10 to push the washer 18 upwards, so that the lower cymbal 5 straddled and mounted onto the pad 19 also is moved in an inclined manner. Thus the lower cymbal 5 can form a desired angle with the upper cymbal 4 or a close contact therewith. As a result, different sound effects can be generated when stricken.

It is to be noted that the lower side of the bottom edge 51 of the nut 50 have grooves 52 formed thereon to be latched by the head 17 of the latch element 16, so that the nut 50 remains securely latched without loosening by the shaking and vibration while the cymbals are stricken.

Figure 1:
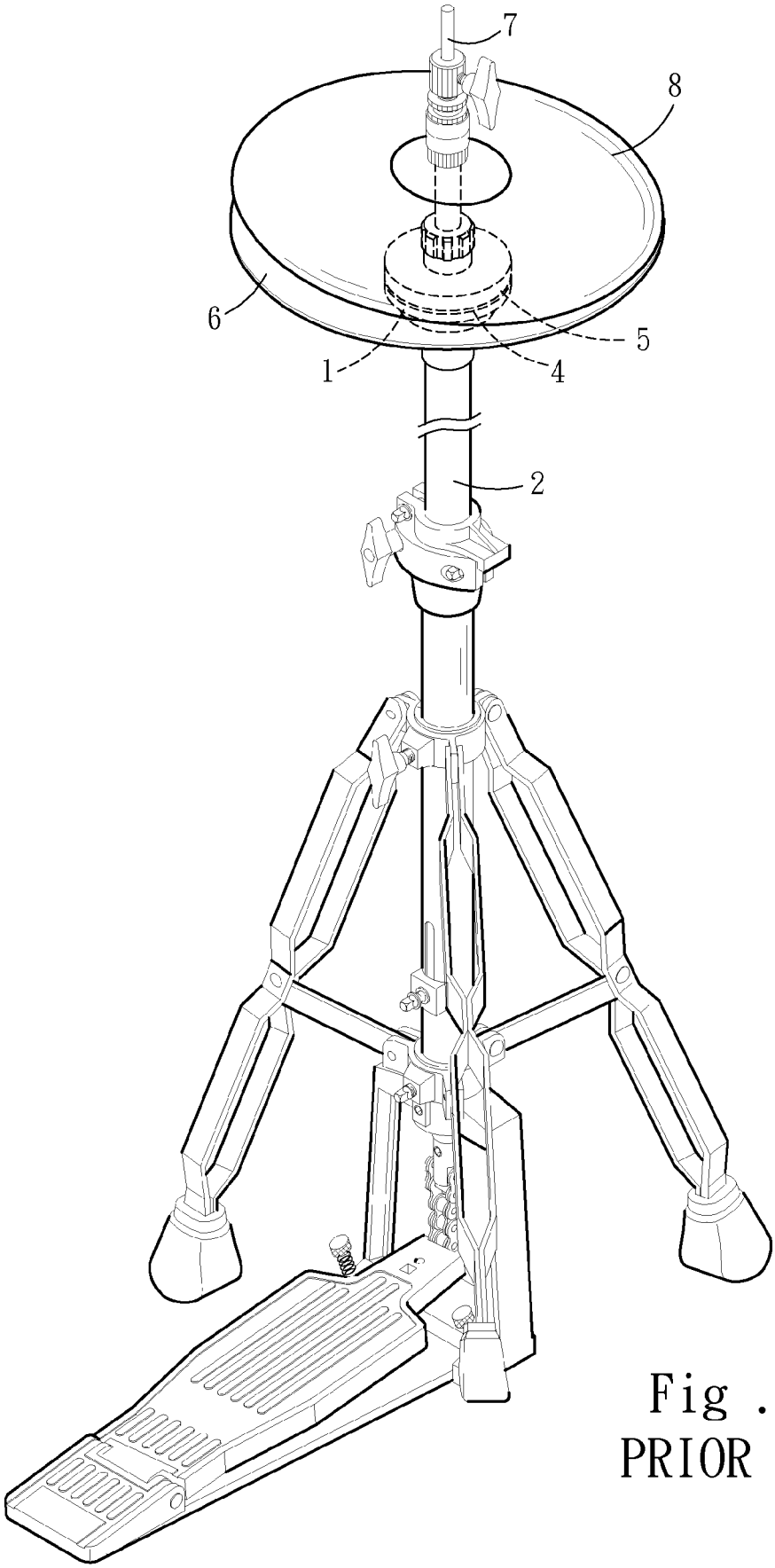
Fig. 1 PRIOR ART
FIG. 1 is a perspective view of a conventional foot-stepping cymbal stand.
Figure 2:
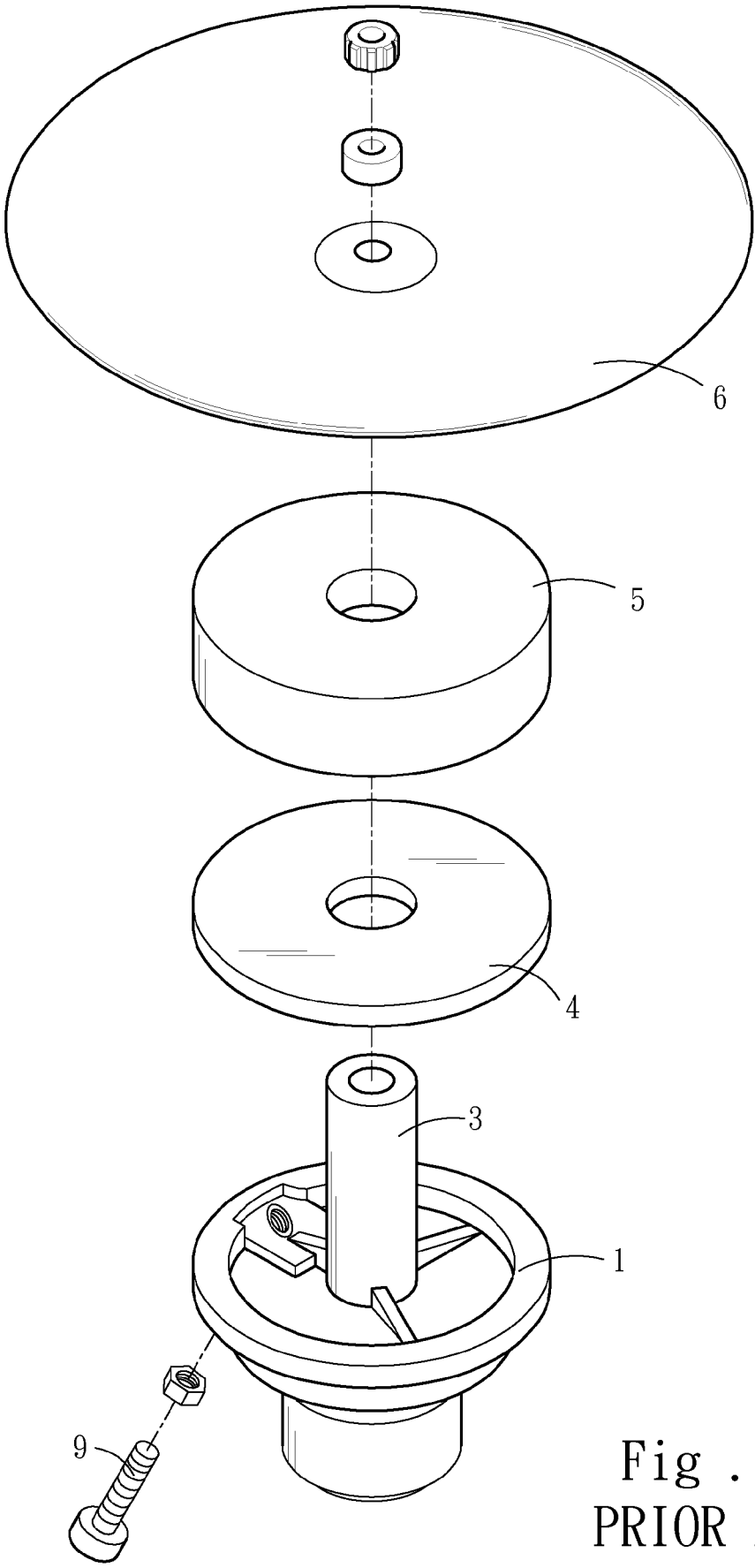
Fig. 2 PRIOR ART
FIG. 2 is an exploded view of the lower cymbal angle adjustment structure of a conventional foot-stepping cymbal stand.

As a conclusion, the invention can provide benefits as follow:

1. The boss 24 pushes the lower cymbal 5 with the flat top surface, thus can prevent the problem of greater stress of the conventional techniques incurred by the point contact on the top end of the screw 9 as shown in FIG. 2 or the lifting bolt 26 in R.O.C. patent application No. 145792.

2. The nut 50 is wedged securely by the head 17 of a pair of opposing latch elements 16, thus loosening and escaping resulting from shaking and vibration can be avoided to maintain the lower cymbal 5 at the desired inclined angle. It prevents loosening of the screw 9 as shown in FIG. 2 or the lifting bolt 26 in R.O.C. patent application No. 145792 that causes changes of the angle of the lower cymbal 11*a*. Sound generation effect can be better controlled. The nut 50 of the invention is a formed at a greater size and can be grasped and handled easier by user's hand. Hence adjustment also is simpler than the smaller bolt 50 in R.O.C. patent application No. M252112.

3. The upper tray 10 has the flange 15 formed on the perimeter to provide a greater force receiving area to hold the washer 18 to support the downward pressure and gravity of the lower cymbal 5, thus can provide firmer support.

What is claimed is:

1. A cymbal adjustment structure, comprising:

an upper tray which is mounted on a post of a cymbal stand and has an aperture formed thereon;

a lower tray which has an external thread on the periphery, a boss extended upwards from the top thereof to run through the aperture of the upper tray when coupling with the upper tray to push a lower cymbal mounted onto the upper tray to change an inclined angle of the lower cymbal; and a nut which has an internal thread engaged with the external thread of the lower tray to position the lower cymbal at the inclined angle;

wherein the upper tray has a conical bottom, the lower tray has a top opening formed at a diameter greater than the bottom thereof to become a conical shape to hold the bottom of the upper tray.

2. The cymbal adjustment structure of claim 1, wherein the upper tray has an upper duct located at an upper side and a lower duct located at a lower side thereof, the lower duct being coupled with the top of the post, the upper duct being formed at a diameter smaller than the lower duct to form a detent edge inside, the lower duct having a pair of opposite troughs on two sides of the tubular wall thereof and a holding member located inside; the lower tray having a bushing at a lower side coupled with the lower duct of the upper tray and run through by at least one fastening element from an outer side of the bushing through the troughs to engage with the holding member and an elastic element is axially compressible and interposed between the holding member and the detent edge.

3. The cymbal adjustment structure of claim 2, wherein the elastic element is a spring.

4. The cymbal adjustment structure of claim 2, wherein the fastening element is a bolt.

5. The cymbal adjustment structure of claim 4, wherein the bolt is a pair located on a left side and a right side.

6. The cymbal adjustment structure of claim 2, wherein the nut has a bottom edge located at the bottom side of the bushing and formed with a plurality of anchor grooves, the post being fastened by at least one latch element on the perimeter thereof, the latch element having a head formed at a diameter greater than the latch element to latch with the grooves.

7. The cymbal adjustment structure of claim 6, wherein the latch element is a screw fastening to the lower duct of the upper tray.

8. The cymbal adjustment structure of claim 1, wherein the upper tray has a washer on the top thereof and a shock-absorbing pad located on the washer to hold the lower cymbal thereon in a straddled manner.

9. The cymbal adjustment structure of claim 8, wherein the upper tray has a flange extended outwards from the perimeter thereof, the flange having a top surface to hold a bottom side of the washer in a straddle manner.

* * * * *